United States Patent [19]

Benoit

[11] Patent Number: 4,924,539

[45] Date of Patent: May 15, 1990

[54] CHILD'S CRIB

[76] Inventor: Roland A. Benoit, 93 S. Main St., Danielson, Conn. 06239

[21] Appl. No.: 422,535

[22] Filed: Oct. 17, 1989

[51] Int. Cl.[5] ..... A47D 7/02

[52] U.S. Cl. ..... 5/100; 5/93 R; 5/99 R

[58] Field of Search ..... 5/93 R, 93 B, 99 R, 5/100, 207, 412, 11

[56] References Cited

U.S. PATENT DOCUMENTS

| | | | |
|---|---|---|---|
| 2,297,963 | 10/1942 | Kroll et al. | 5/93 R |
| 3,129,439 | 4/1964 | Michal | 5/207 |
| 3,636,571 | 1/1972 | Winer | 5/100 X |
| 3,760,434 | 9/1973 | Neunherz et al. | 5/100 X |
| 4,703,524 | 11/1987 | Brunner et al. | 5/93 R |
| 4,706,312 | 11/1987 | Shamie | 5/100 X |
| 4,752,978 | 6/1988 | Simpson | 5/93 R |
| 4,768,243 | 9/1988 | Waples | 5/100 |
| 4,802,248 | 2/1989 | Moroney et al. | 5/93 R X |
| 4,825,482 | 5/1989 | Paris | 5/100 X |
| 4,850,066 | 7/1989 | Benoit | 5/100 |

*Primary Examiner*—Gary L. Smith
*Assistant Examiner*—Michael Milano
*Attorney, Agent, or Firm*—Charles R. Fay

[57] ABSTRACT

A dropside crib comprising a rear wall, two end panels, a dropside, a stabilizer bar, and a mattress support, all quickly and easily assembled without any tool needed. Special dropside guides and a double action device are built in and operate the dropside according to regulations. The mattress support comprises a set of four independently operated crank-like members that suspend the support in one position and are reversible to hold the support up from the suspended condition.

10 Claims, 4 Drawing Sheets

CHILD'S CRIB

BACKGROUND OF THE INVENTION

This invention is based and provides improvements on the Child's Crib disclosed in U.S. Pat. No. 4,850,066, dated August 25, 1989. The improvements are for the purpose of rendering the catch holding the dropside up, the mattress spring support, and the stabilizing bar easier to operate or less expensive to manufacture or both. Otherwise, the cribs disclosed in this application and the patent are generally alike.

The dropside catch is actuated by a button in this application. The stabilizer bar is assembled by pulling it toward the assembler and then pushing it down with one hand only if so desired, rather than locating the ends separately with a longitudinal action. The main change is in the mattress support application to the corner posts and means of adjustment thereof vertically. It has been found that only two positions are necessary; an up position for a young baby and a down position for an older child, and the new construction is easier to change between its two positions.

SUMMARY OF THE DISCLOSURE

The present crib comprises two end panels, a front side, a rear side and a mattress support. The front side is slidable up and down on corner posts that are part of the end panels, and the rear side may be fixed relative to the end panels, or of course it could also slide like the front side.

A locking rod is mounted in the top rail of the dropside to be moved rotarily to latch the dropside up, with a button and a device to force the dropside to be lifted slightly simultaneously with action on the button to cause the rod to rotate to release the drop side. The mattress support per se may be of any usual description except that it has novel connections to the two end panels, these connections having crank-like hangers being spring pressed into place on the end panels at two selected vertical positions, the hangers being swingingly connected to the mattress support at its ends. There is also a stabilizer or a stiffener bar that extends between the front side end panel corner posts. Where the rear side is fixed in position, there is no need of such a stiffener at the rear side, but at the front side the dropside is located, and it adds to the rigidity and strength of the crib.

The connections of end panels to rear and front sides are semi or better bayonet slots and headed fasteners made so that they rigidify the parts into a rigid rectangular form simply by assembly of the heads in the slots and the placement of the stiffener at the rear aspect of the end panels, out of the way and out of casual sight. This stiffener is assembled by headed fasteners also, but it is moved laterally of the crib to become fastened to the end posts at the rear aspects thereof. Thus, the stiffener bar is moved with a simple motion to fasten or fasten it with respect to the end posts of the crib.

PREFERRED EMBODIMENTS OF THE INVENTION

Figure 1:
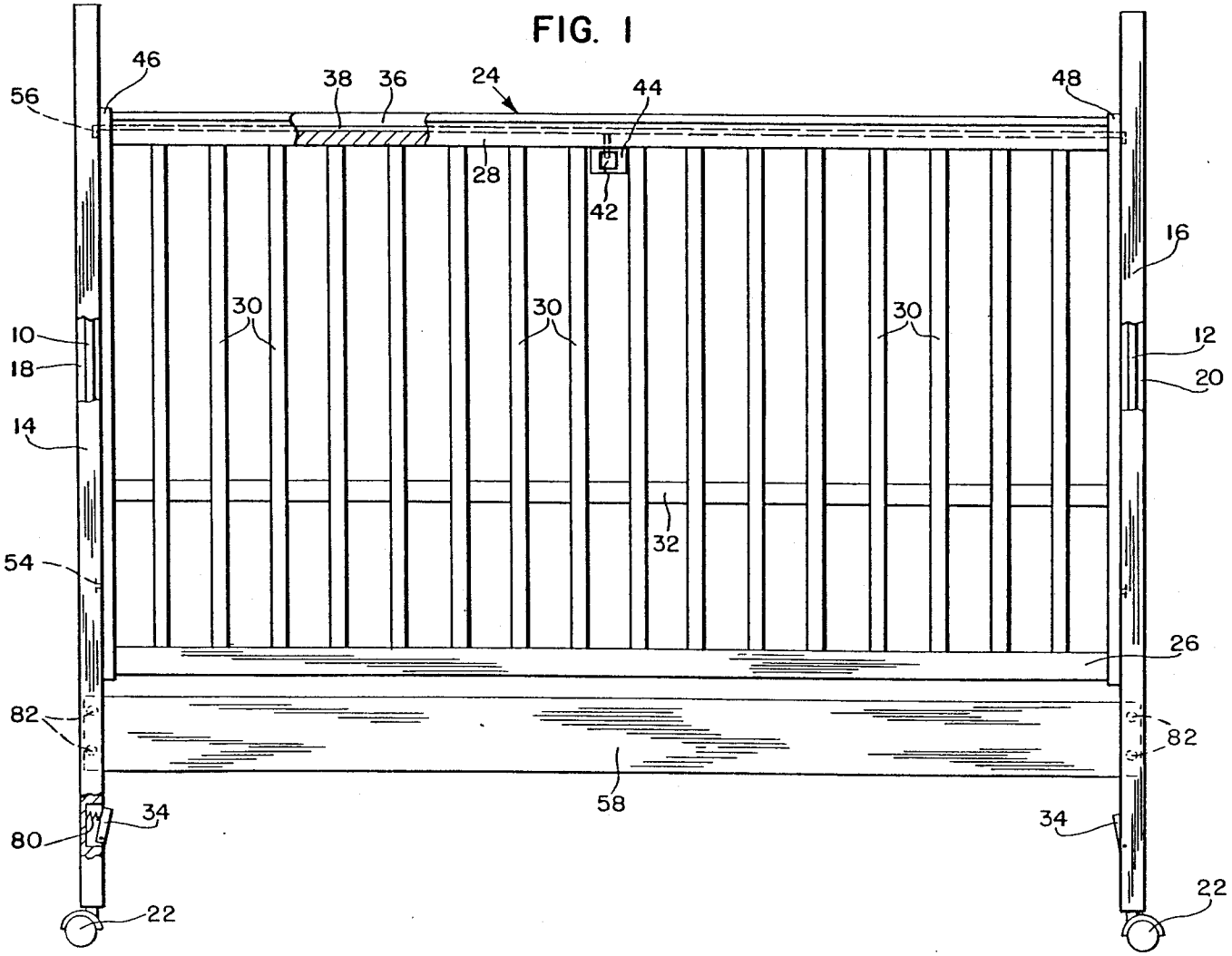
FIG. 1 is a front elevational view of the new crib, part broken away and in sections.

FIG. 1 shows the front side of the crib which has end panels 10, 12, each end panel having corner posts 14, 16 and 18, 20, or equivalent, and casters or the like 22, 22. There is a rear side not shown in FIG. 1, but of any appropriate general construction, and a front dropside generally indicated at 24. The dropside has a bottom longitudinal rail 26 and a top rail 28, the rails being connected by stiles 30 connected in any convenient way. The mattress support or spring is indicated generally at 32 and connected to the corner posts of the end panels, as will appear more fully hereinafter. Spring pressed abutments 34 stop and support and dropside in lowermost position.

The top rail 28 has a longitudinal top groove 36 from end to end and a long rod 38 is located in groove 36, the groove, top of rail 28, and the rod 38 being closed and concealed by a conventional safety cap of the usual construction. At its opposite ends, rod 38 is provided with latches located in the corner posts 14 and 16, and centrally of rod 38 there is a spring biassed button 42 for actuating the rod and the latches to release the dropside so it can fall to the abutments 34. This button may be round or square.

Figure 3:
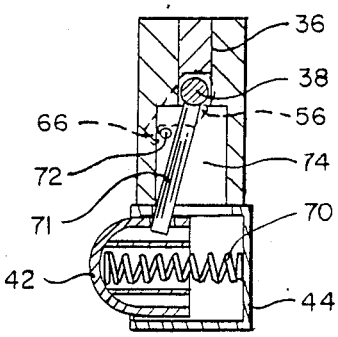
FIG. 3 is a vertical section on an enlarged scale through the top rail of the crib dropside to show the lock therefor and the manual trip for it.

To aid in fastening the dropside securely to the front corner posts 14, 16, the dropside has end members 46 and 48 that have flat sides facing the corner posts. The later also have flat sides, facing inwardly of the crib, see FIG. 3, and inlaid in the corner posts are metal or plastic undercut type tracks as at 50, 52. The vertical end members have T-head screws or pins 54 that ride in tracks 52, to provide lower portion of the dropside to track in the slot and the rod 38 extends through the members 46 and 48, terminating in flat offset radially extending latch tabs 56, FIG. 4, that accomplish the same function in tracks 50. This construction is duplicated at the other end of the crib, so that the dropside is easily slid upwardly to the latched position of FIG. 1, from its down position, wherein the end members 46 and 48 rest on abutments 34. Abutments 34 each have a spring 80 which keeps the abutments outwards. In dismantling the crib, abutments 34 must be depressed to allow the dropside lowering further and becoming clear of the tracks 50, 52.

Figure 2:
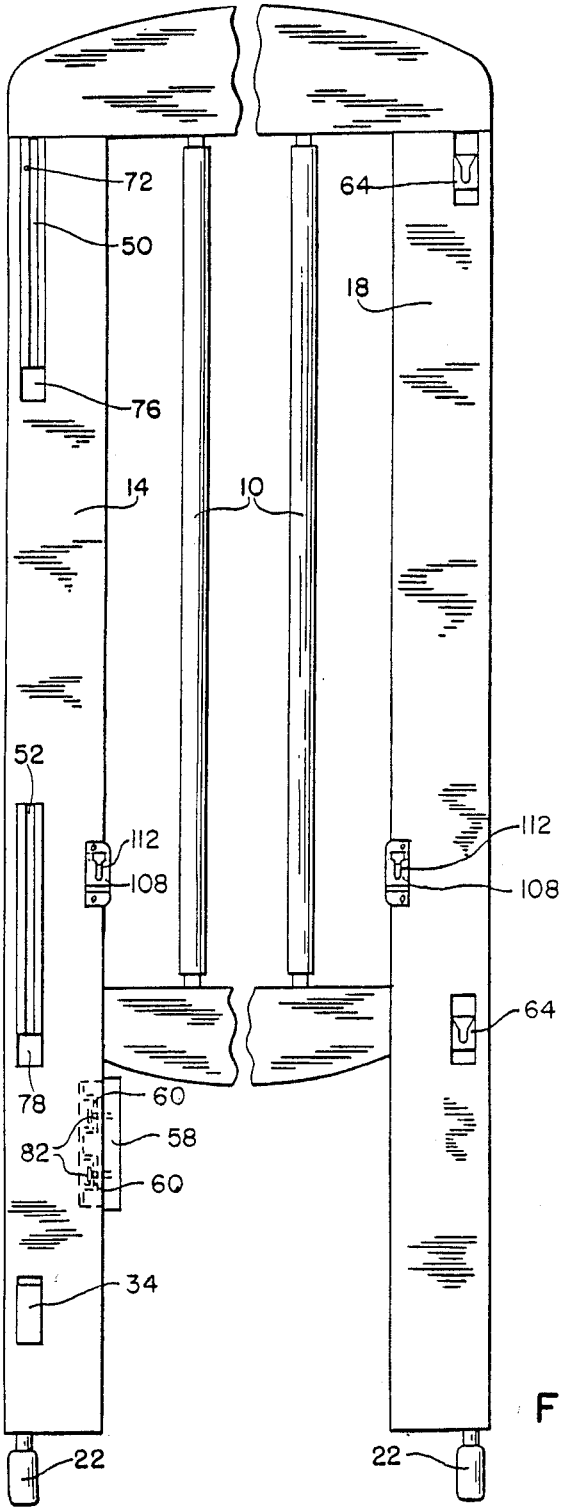
FIG. 2 is an elevational view of the left hand end panel of FIG. 1, parts being broken away.

Just behind the dropside, in the crib but very close to the dropside there is the stiffening or stabilizer bar 58 that has a pair of spaced T-head fasteners 82 at each end that go into open top slotted receivers 60 on each of corner posts 14 and 16, FIG. 2, and when forced in the receivers 60, toward the front of the crib, and then down, holds the end panels in fixed relation.

When assembling the crib, the rear wall is put on first with the same T-heads fitting in receivers 64, 64. Then the dropside is assembled, tab 56 and T-head 54 being located in the spaces 76 and 78 below the tracks 50, 52, FIG. 1. Simultaneously abutment 34 is being depressed by the end members 46, 48. The dropside is then raised permitting tab 56 and T-head 54 to slide into the tracks 50, 52, allowing abutment 34 to snap out trapping the dropside in the sliding tracks. The stabilizer bar is assembled last, in order for the dropside to be assembled as described, so it is pulled forward and then down, as above described. This construction of the stabilizer bar allows its assembly with one hand, if wanted.

Figure 4:
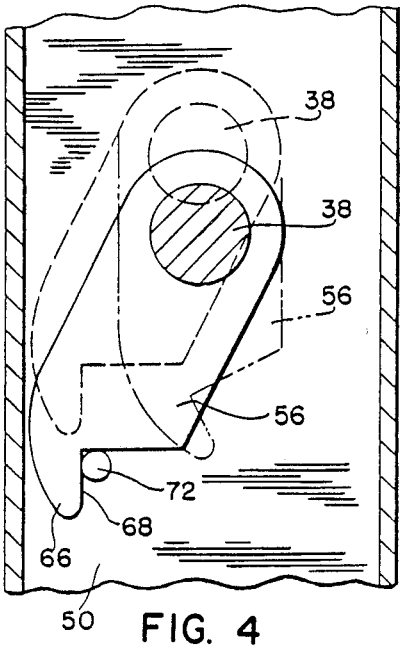
FIG. 4 is a greatly enlarged detail of the dropside lock and illustrating its action.

The tab 56 has a beak 66 and a notch 68, see FIG. 4, that is normally in the solid line position, held by any kind of spring, such as coil spring 70 bearing on the button 42 and also a spur 71, fixed to rod 38, is held forward, and maintains the latch, holding it forwardly. In this position, when the dropside is pushed up, a small fixed pin 72 forces tab 56 to snap past the beak 66 acting as a cam. As soon as the beak passes the pin 72, it snaps forwardly and latches the tab 56 over the pin. It will be noted that the tab goes up past its latching position, so that it must be manually raised before pressure on button 42 is able to turn rod 38 enough to clear the pin 72, and let the dropside drop. Thus the "double action" necessary to lower the dropside is accomplished, and accidental lowering of the dropside is averted. It is also to be noted that the tab 56 cannot be moved to a position to release it from the track 50 because the possible motion of the button 42 and rod 38 is very limited in its enclosure at 74.

In assembling, the rear wall is applied first, by forcing its headed fasteners down into the receivers 64 on the two end panels. This gives a three sided structure open at the front.

Figure 7:
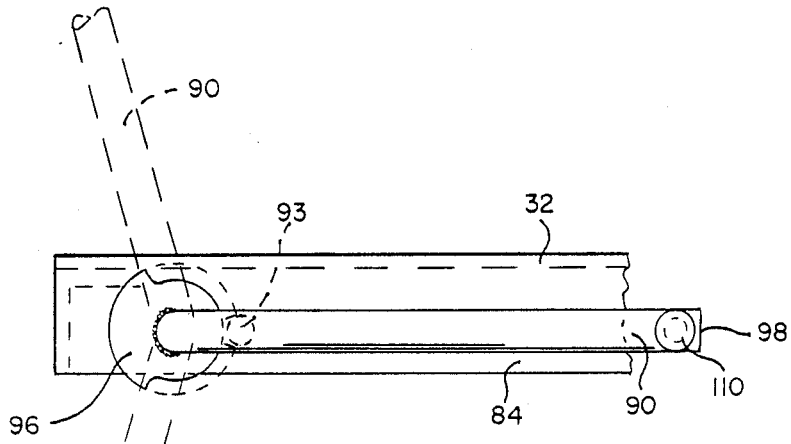
FIG. 7 is an edge view looking in the direction of arrow 7 in FIG. 6.

The novel adjustable supports for the mattress support spring generally indicated at 90 are shown in detail in FIGS. 5–9. The spring 32, as a whole, may be conventional, with the usual side irons 81 and interconnected end irons 84 connected in a box form by riveting or welding overlapping flanges, all as well-known to the art, and using some kind of netting 86 and springs 88. To each end iron 84, a pair of crank-like connectors 90 are pivoted near the opposite ends of the end irons 84. Each connector has a captive end forming a swivel as by bent-in end 94 located to rotate in a corresponding hole in the end iron. Stop plates 96 are used to limit the swing arc of each connector 90, by coming to rest against the stop pin 93, see FIG. 7, and thus each connector is limited to the degree shown in FIG. 7. These limits define the two positions of the connectors: up and down in dotted lines, FIG. 7 showing the connector in solid lines in a half-way position wherein the free end 98 of the connector 9 is completely free of the crib.

Figure 6:
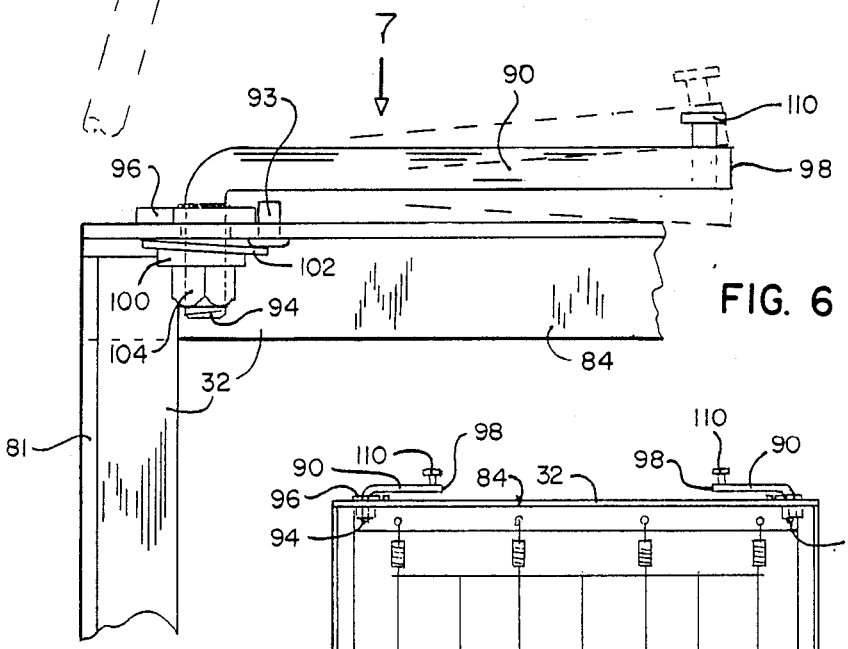
FIG. 6 is a view similar to FIG. 5 but showing a single connection on a larger scale.
Figure 5:
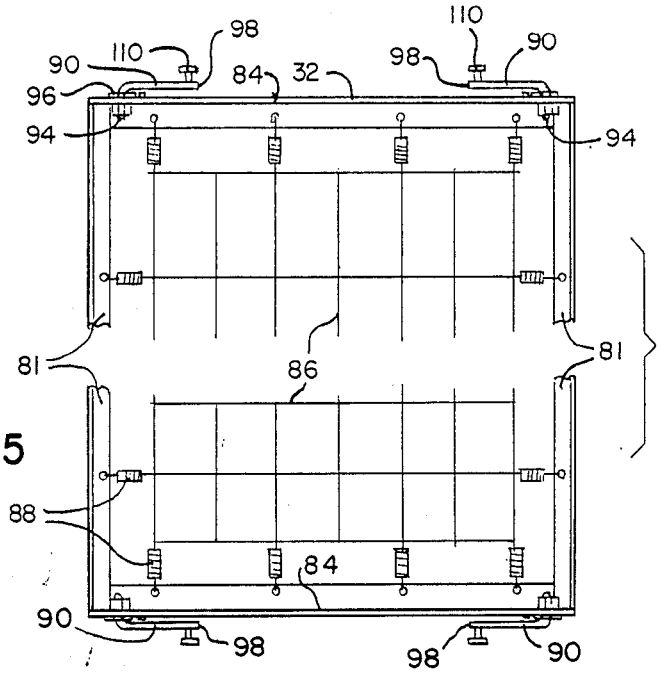
FIG. 5 is a plan view in detail of the mattress supporting element and its connections to the end panel corner posts.
Figures 8, 9:
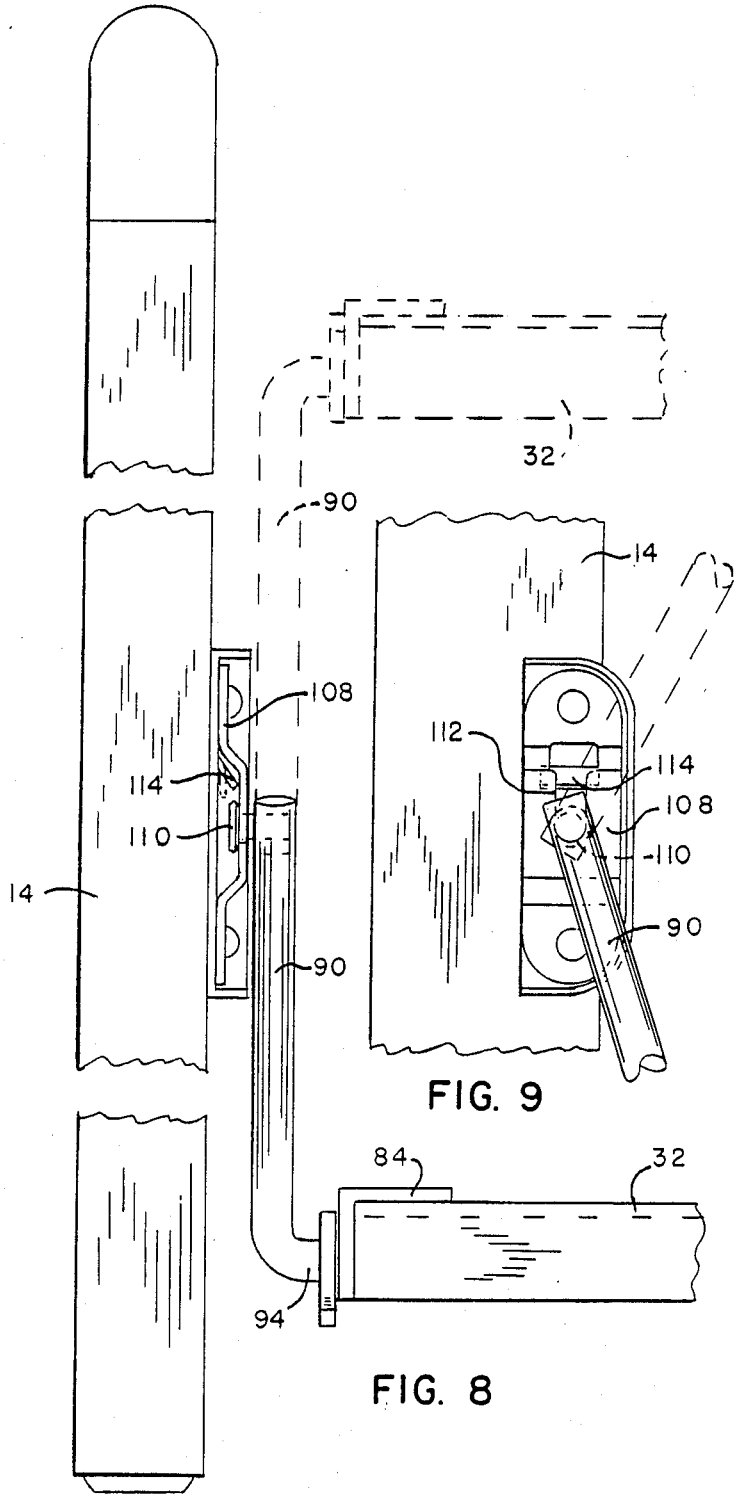
FIGS. 8 and 9 are further detail views of the mattress support connection to a corner post.

Connectors 90 are also rockable at the permanent connections to the irons 84, through the use of a rubber washer 100 and a steel washer 102, under nut 104 that holds the threaded end of the bent-in end 94 of each connector in assembled relation to irons 84, FIG. 6. This rocking action is to allow the connectors ends 98 to be connected and taken down relative to a corner post of the crib and catch plate 108 thereon. Each connector 90 has a headed pin 110 that joins or connects to catch plate 108 by means of keyhole slots 112, see FIGS. 2 and 9. There is but a single catch-plate for each connector, but the crib spring has two vertically different elevations. With the connectors down, see FIGS. 8 and 9, solid lines, the spring structure 32, etc., is at the low position, for a child who can stand up; and with the connectors changed to up position, dotted line, FIG. 8, the mattress will be located in high position, as for a baby too young to stand up. When the connectors 90 are down, the mattress is obviously held securely; with the connectors 90 up, they are held fixed by the spring itself, so the mattress is also held securely in this position also. A free-ended tab 114 which is flexible, is fixed in each catch plate with its free end pointed at the head of pin 110, and the connectors cannot accidently be dislodged. The tab has to be bent back, as by a small tool like a screwdriver in order to allow release of the proximate connector.

I claim:

1. A crib comprising a rear wall, two end panels, a front dropside, headed fasteners at the ends of the rear wall and cooperating head receivers on the panels for connection with the heads of the fasteners, dropside latch structure for holding the dropside in an up position, said latch structure including a track on each panel, a latch operating rod, radially extending latch tabs on the ends of the rod, said tabs being located respectively in the tracks, a headed fastener at each end of the dropside in positions removed from the latch operating rod, and tracks on the panels to receive the heads of the last named fasteners, so that the latch tabs act as guides for the up and down motion of the dropside together with the heads on the headed fasteners on the dropside;

the latch structure including a pin in each of the first named tracks, the latch tabs being in the form of hooks that cooperate with the pins to latch the dropside in up position, and means to partially rotate the latch operating rod to free the hook-like tabs from the pins to allow the dropside to drop, said last named means including a spring biassed button and a spur on the rod engaging the button so that the rod is turned to release the tabs from the pins.

2. The crib of claim 1 wherein the dropside is capable of being manually raised above the hook-like tab pin engaging position.

3. A crib comprising a rear wall, two end panels, a front dropside, and a panel to panel stabilizer bar adopted to be assembled without the use of tools, including headed fasteners at the ends of the rear wall and cooperating head receivers on the panels for connection with the heads of the fasteners, dropside latch structure for holding the dropside in an up position, said latch structure including a track on each panel, a latch operating rod, radially extending latch tabs on the ends of the rod, said tabs being located respectively in the tracks, a headed fastener at each end of the dropside in positions removed from the latch operating rod, and tracks on the panels to receive the heads of the last named fasteners, so that the latch tabs act as guides for the up and down motion of the dropside together with the heads on the headed fasteners on the dropside, headed fasteners at the front side of the stabilizer bar near the ends thereof, and hard receiving tracks therefore on the end panels, said last named fasteners extending transversely to the stabilizer bar and being connected to the end panels by a rear-to-front pull.

4. A crib including end panels, a rear side, a front side, a rectangular mattress support in operative condition in the crib in two vertically different locations, said mattress support holding means comprising a swivelable rod adjacent each of the four corners of the support, said rods being swively mounted at a single corresponding end to the support and being swiveled relative to the support between positions wherein the rods are principally above the support and positions wherein the rods are principally below the support, four catch-plates mounted on the crib, one such catch-plate adjacent each of the four corners of the crib where the end panels and rear and front sides conjoin, and interconnecting means between each catch-plate and the free-end of the separate swiveled rod.

5. The crib of claim 4 including retractable spring means on each catch plate to retain a portion of a separate rod connected thereto preventing accidental dislocation of the rods from the catch plates.

6. The crib of claim 4 wherein the catch plates are on the end panels.

7. The crib of claim 4 including means associated with each rod and the adjacent portion of the support to provide a rocking action of the rods on an axis transverse of the rods to allow motion of the rods to and from the catch plates under manual influence.

8. The crib of claim 5 wherein the interengaging means between the catch plates and free-ends of the rods includes a vertical undercut slot on each catch plate and a cooperating headed transversely arranged member on each rod.

9. The crib of claim 8 wherein the retractable spring means on each catch plate comprises a free-ended spring in a position to prevent the rods from dislocation while engaged in the catch plates in mattress support holding position.

10. The crib of claim 7 wherein said rod rocking motion means comprises and elastomeric washer.

* * * * *